US008006458B1

(12) United States Patent
Olofsson et al.

(10) Patent No.: US 8,006,458 B1
(45) Date of Patent: Aug. 30, 2011

(54) FLOORING MATERIAL COMPRISING BOARD SHAPED FLOOR ELEMENTS WHICH ARE JOINED VERTICALLY BY MEANS OF SEPARATE ASSEMBLY PROFILES

(75) Inventors: Ola Olofsson, Trelleborg (SE); Göran Mårtensson, Klagstorp (SE)

(73) Assignee: Pergo AG, Baar (CH)

( * ) Notice: Subject to any disclaimer, the term of this patent is extended or adjusted under 35 U.S.C. 154(b) by 1708 days.

(21) Appl. No.: 09/806,941

(22) PCT Filed: Sep. 27, 1999

(86) PCT No.: PCT/SE99/01701

§ 371 (c)(1), (2), (4) Date: May 21, 2001

(87) PCT Pub. No.: WO00/20706

PCT Pub. Date: Apr. 13, 2000

(30) Foreign Application Priority Data

Oct. 6, 1998 (SE) ..... 9803379-8
Feb. 10, 1999 (SE) ..... 9900432-7
Aug. 12, 1999 (SE) ..... 9902883-9

(51) Int. Cl.
*E04B 5/02* (2006.01)
*E04B 5/43* (2006.01)

(52) U.S. Cl. ..... 52/582.1; 52/586.2; 52/585.1; 52/586.1; 52/489.1

(58) Field of Classification Search ..... 52/582.1, 52/588.1, 579, 578, 583.1, 586.1, 585.1, 52/605, 604, 782.1, 800.1, 396.05, 403.1, 52/480, 489.1, 586.2, 570, 699
See application file for complete search history.

(56) References Cited

U.S. PATENT DOCUMENTS 2,534,501 A * 12/1950 Coleman ..... 52/588.1
2,863,185 A 12/1958 Riedi (Continued)

FOREIGN PATENT DOCUMENTS

DE 2145024 3/1973

(Continued)

OTHER PUBLICATIONS

English language abstract of FR 2697275.

(Continued)

*Primary Examiner* — Phi D. A
(74) *Attorney, Agent, or Firm* — Novak Druce Quigg LLP

(57) ABSTRACT

Vertically joined flooring material comprising floor boards (1), which floor boards (1) are provided with edges (2) which are provided with a groove (2'), a lower side (5) and a decorative top surface (3). The floor boards (1) are intended to be joined by means of separate joining profiles (10). All edges (2) are provided with one groove (4) each, which grooves (4) are arranged parallel to its respective edge (2). The joining profiles (10) are provided with lips (11) arranged in pairs, which lips (11) each are intended to be received by the groove (4) of a floor board (1) guiding and fixing adjacent floor boards (1) horizontally. The joining profile (10) is provided with a central cheek section (13) which is comprised by a first and a second independently resilient cheek (13' and 13" respectively). The cheek (13' and 13" respectively) are provided with one tongue (14' and 14" respectively) each whereby the tongues (14' and 14" respectively) are intended to be received by one groove (2') each so that adjacent floor boards (1) are guided in a vertical direction.

16 Claims, 2 Drawing Sheets

U.S. PATENT DOCUMENTS

Figure 1A:
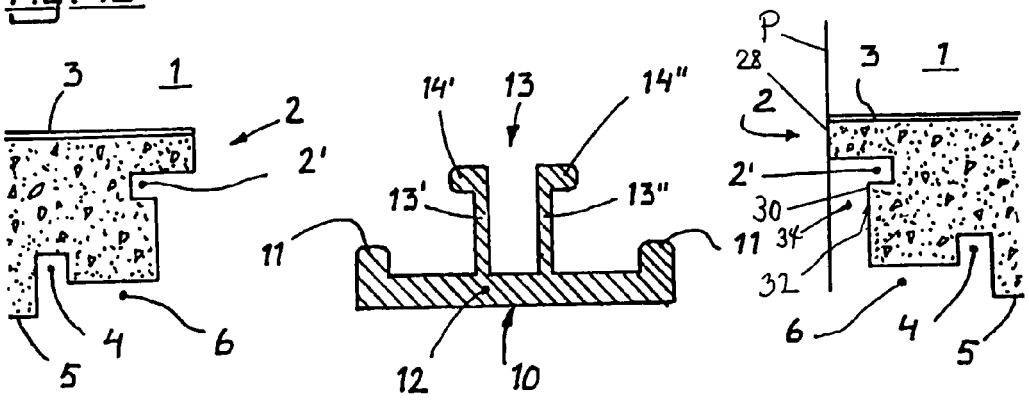

| | | | | | |
|---|---|---|---|---|---|
| 3,045,294 | A | * | 7/1962 | Livezey, Jr. | 52/586 |
| 3,145,503 | A | * | 8/1964 | Brechin | 52/699 |
| 3,331,176 | A | * | 7/1967 | Washam | 52/586 |
| D221,529 | S | * | 8/1971 | Kimmel | 52/586.1 |
| 3,605,368 | A | * | 9/1971 | LaLouche | 52/460 |
| 3,884,008 | A | * | 5/1975 | Miller | 52/699 |
| 4,067,155 | A | | 1/1978 | Ruff et al. | |
| 4,169,688 | A | * | 10/1979 | Toshio | 404/40 |
| 4,435,935 | A | * | 3/1984 | Larrea | 52/461 |
| 4,461,131 | A | * | 7/1984 | Pressell | 52/395 |
| D282,783 | S | * | 2/1986 | Rezewski | D25/124 |
| 4,599,841 | A | | 7/1986 | Haid | |
| 4,599,842 | A | * | 7/1986 | Counihan | 52/586 |
| 4,766,443 | A | * | 8/1988 | Winegard et al. | 343/840 |
| 5,016,413 | A | * | 5/1991 | Counihan | 52/391 |
| 5,058,333 | A | * | 10/1991 | Schwartz | 52/73 |
| 5,950,389 | A | | 9/1999 | Porter | |
| 6,164,031 | A | * | 12/2000 | Counihan | 52/480 |
| 6,321,499 | B1 | * | 11/2001 | Chuang | 52/480 |

FOREIGN PATENT DOCUMENTS

| | | | | |
|---|---|---|---|---|
| DE | 03932980 | | 11/1991 | |
| DE | 209979 | | 5/2009 | |
| FR | 2 268 922 | | 4/1974 | |
| GB | 471438 | * | 9/1937 | 52/586 |
| GB | 2124672 | * | 6/1982 | 52/588.1 |
| GB | 2228753 | | 9/1990 | |
| SE | 8202375 | | 10/1983 | |
| SE | 82023755 | | 10/1983 | |
| WO | 9313280 | | 7/1993 | |
| WO | 9426999 | | 11/1994 | |
| WO | 9747834 | | 12/1997 | |

OTHER PUBLICATIONS

English language abstract of SE 462809.
Brief description of FR 9 268 922.
Co-pending U.S. Appl. No. 09/806,994.

* cited by examiner

FLOORING MATERIAL COMPRISING BOARD SHAPED FLOOR ELEMENTS WHICH ARE JOINED VERTICALLY BY MEANS OF SEPARATE ASSEMBLY PROFILES

The present invention relates to a flooring material comprising board shaped floor elements which are joined vertically by means of separate assembly profiles.

Prefabricated floor boards which are provided with tongue and groove at the edges are well known today. As these are rather easy to install, this can be achieved by the average handy man. Such floors can be made of solid wood, particle board or fibre board. These floor boards are most often provided with a top surface, such as lacquer or some kind of laminate. The board are most often joined by being glued together via their tongue and groove. The most common types of floor boards are, however, burdened with the disadvantage to form gaps of varying width between the floor boards if the installer is not thorough enough. Dirt will accumulate in such gaps. Moisture will furthermore enter the joints which will cause the core to expand in cases where it is made of solid wood, fibre board or particle board which usually is the case. This expansion will cause the top surface to rise, closest to the joint, which radically decreases the useful life of the floor due to increased wear on the protruding edges of the floor board. In order to avoid this type of gaps it is known to use different type of tensioning devices used for forcing the floor boards together during installation. This operation is, however, rather awkward and it is desirable to achieve a floor board with a joint which is self-orienting and thereby automatically will find its correct position. It would also be possible to use such a joint without having to use glue.

One such floor is known through WO 93/13280 wherein a form of clips is intended to keep floor boards together. The floor boards are, besides being provided with traditional tongue and groove, also provided with a single longitudinal groove on the side facing downwards. The floor boards are resting on the clips why a great number of such clips will have to be used to avoid resilient movements in the floor. Such movements will cause noise. The distance between the floor boards and the surface below will also cause acoustic resonance which will give the floor a "noisy" character. This is not desirable. The disadvantage with a groove and tongue solution is foremost that the tongue will have to be milled from the board which will cause a loss of the expensive top surface. It will furthermore be possible to assemble the floor boards, oriented in one direction only. The tongue is also a delicate part which is easily damaged during transport and handling which makes assembly difficult or causes impaired fitting.

Another such floor is known through Swedish patent application No. 8202375-5 in which floor boards are provided with grooves at the opposite edges. A separate profile, in which a tongue is included, is used for guiding the boards horizontally. The lower part of the profile is also provided with girders protruding upwards.

These girders are intended to interact with grooves on the lower side of the floor boards. A floor according to Se application No. 8202375-5 will however have to be assembled in a way that makes it necessary for the installer to stand on his knees since the floor will have to be turned into, or slided sideways, into the desired position.

It has, through the present invention been possible to solve the above mentioned problems, whereby a floor that can withstand handling, demands a minimum of milling of the decorative top surface and is easy to install has been achieved. The invention relates to floor boards which are joined vertically, with a mainly square, rectangular, rhomboidal or polygonal shape, as seen from above. The floor boards are provided with edges which are provided with a groove, a lower side and a decorative top surface. The floor boards are intended to be joined by means of separate joining profiles. The invention is characterised in that all edges are provided with one groove each, which grooves are arranged parallel to its respective edge. The joining profiles are provided with lips arranged in pairs, which lips each are intended to be received by the groove of a floor board so that adjacent floor boards with the grooves at the adjacent edges is guided and fixed horizontally by the lips of a joining profile. The lips are connected to each other by a middle section of the joining profile. The joining profile is provided with a central cheek section which is comprised by a first and a second independently resilient cheek which cheeks are provided with one tongue each. The tongues are intended to be received by one groove each so that adjacent floor boards are guided in a vertical direction.

The grooves on the lower side of the floor boards are suitably arranged on distance from the closest edge less than half, preferably less than one quarter of the width of a floor board.

The floor boards are suitably provided with a groove at the edges. The distance between each groove and the closest edge is mainly the same.

The part of the floor board located between each edge and its respective groove is preferably thinner than the maximum thickness of the floor board by means of a recess located on the lower side.

The distance between the lips of the joining profile is preferably somewhat smaller than the distance between the grooves placed on each side of and closest to the edge of two adjacent floor boards. The joining profile will hereby exercise a clamping force on the joint.

The joining profiles are suitably manufactured in long sections which suitably are manufactured through extrusion which is a well known and rational manufacturing method. The joining profiles may then be provided in different lengths or in rolls which may be cut into a desired length during the assembly. The length of the joining profiles suitably exceeds the length of a floor board before being cut. One advantage with such long joining profiles is that joining profiles may be installed in full-length over, for example, the width of the floor which will reduce the risk for gaps in the joints in cases where the lateral joints overlap. Such assembly where the joints between the floor boards overlap in both directions may of course be used even if the joining profile has the same length as, or is shorter than, the floor boards. The shorter side edges of the floor boards may be joined by using shorter lengths of the joining profile. The joining profiles are installed gradually as each new row of floor boards are joined with the previously installed one. The flooring material according to the present invention is very suited for being installed without any use of adhesives such as glue. It is of course possible to use adhesives to make the assembly more permanent by apply or coat parts of the joining profiles or parts of the floor board with glue or double-faced adhesive tape. The glue or tape is then suitably applied on the surfaces of the joining profiles situated between the lips as well as on the edges of the floor boards. Since the floor boards according to the present invention is provided with the same geometry along all of the edges it will become possible to turn the floor board in the desired direction. It will therefore be possible to perform patterned design installations for the layman.

According to the present invention the joining profiles constitute separate parts in opposite to the most common types of flooring materials using tongue and groove. This will be a great advantage in connection to manufacturing, transport and installation since traditional joining incorporates very delicate and sensitive parts. These parts are traditionally made of fibre board or particle board which are very easy to either brake or deform. Damaged floor boards will normally have to be rejected. Joining profiles according to the present invention may be manufactured from a number of materials and through a number of different manufacturing methods. Among suitable methods can be mentioned injection moulding and extrusion. Suitable materials are thermoplastic materials such as poly olefins, polystyrene, polyvinyl chloride or acrylnitril-butadiene-styrene-copolymer. These can be filled with for example sawdust, cellulose or lime to foremost increase the dimension stability but also to increase the adhesion when being glued.

According to an alternative embodiment of the invention a decorative strip is intended to be installed from above into an intentional gap formed between two floor boards. The decorative strip is preferably provided with heels at its lower part. The heels are intended to snap-join with depressions on the joining profile. The decorative strip is further provided with shoulders which are intended to rest against the upper edges of the joining profile.

Such a decorative strip may be used to increase the decorative effect in a floor and can be installed between every second or third floor board as well as between every floor board. The upper surface of the decorative strip may be covered with a decorative thermosetting laminate with a pattern that matches the rest of the floor. Also profiles made of metal might be used. Among other materials that might be used can be mentioned poly olefins, polystyrene, polyvinyl chloride and acrylnitril-butadiene-styrene-copolymer. These can be filled with for example sawdust, cellulose or lime to foremost increase the dimension stability but also to increase the adhesion when being glued. In cases where the decorative strip is to be provided with upper surface of thermoplastic laminate it is suitable to manufacture the decorative strip of a thermoplastic material with 15-60% filler of for example cellulose powder. It is also possible to use the decorative strip as a dilatation device, i.e. to absorb temperature and moisture related expansion in the floor. The decorative strip is then suitably manufactured of a thermoplastic elastomer.

A flooring material according to the present invention is suited for installations without use of glue. It is of course possible to use glue or double-faced adhesive tape in order to make the installation completely permanent. The glue or tape is then suitably applied in, or in connection to, possible cavities in the joint before the assembly.

The floor boards according to the present invention is assembled by being pressed downwards to snap-join with previously installed floor boards. Commonly known floor boards are assembled horizontally by being forced or knocked together. Some known floor boards are assembled by being turned or prized into position. These known floor boards are guided vertically and in a few cases also horizontally on a great number of variations on the tongue-and-groove theme. It is very difficult to apply sufficient horizontal force manually at floor level whereby different types of tensioning devices are essential when installing such floors. The installer will only have to apply some of his body weight over the joint and the floor boards will snap together, when installing floors according to the present invention. It is hereby becomes possible walk the floor boards into position once they are placed correctly.

It is also possible to lay the floor standing up by using very simple tools, for example a couple of rods with a suction cup at the lower ends. It would thereby be possible to install the floor without having to crawl on ones knees. Industrial injuries such as back and knee problems are very common by floor installers. It also becomes possible to remove a floor board even though it is completely surrounded by other floor boards, provided it isn't glued. This operation is suitably achieved by using a more powerful type of suction cup to lift the floor board, one edge at the time. It is also possible to drill a hole in the floor board to be replaced in order to get a place to clutch the board. Among reasons why a single floor board needs to be changed are when a heavy object, such as a flat iron, is dropped on the floor. It has until now been possible only for a professional floor installer to achieve a repair in these types of floors since great experience of profession and a multitude of tool are needed. Such a repair is naturally very costly. It has through the present invention been made possible for a layman to achieve such a repair without having to utilise special tools.

Figure 1B:
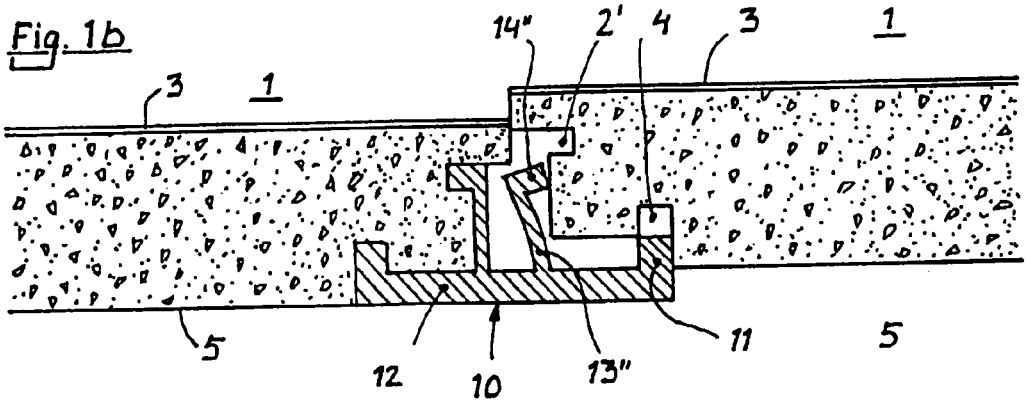
Figure 1C:
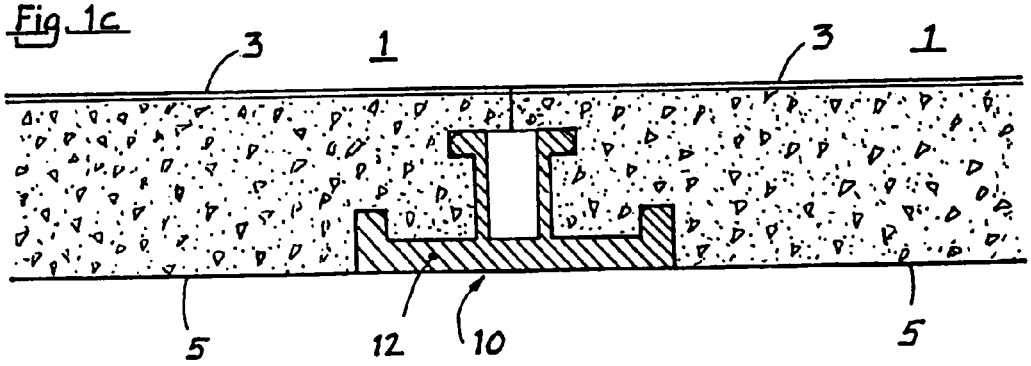

The invention is described further together with enclosed drawings showing different embodiments of a flooring material according to the invention whereby, FIG. 1*a*-1*c* show in exploded view and in cross-section a first embodiment of a flooring material according to the invention, before, during and after the assembly.

Figure 2A:
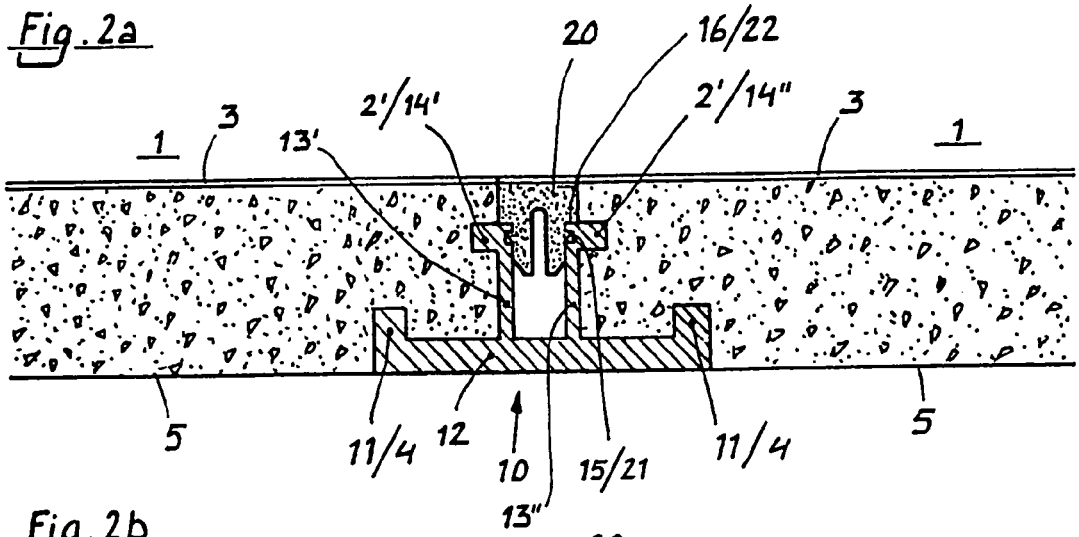
Figure 2B:
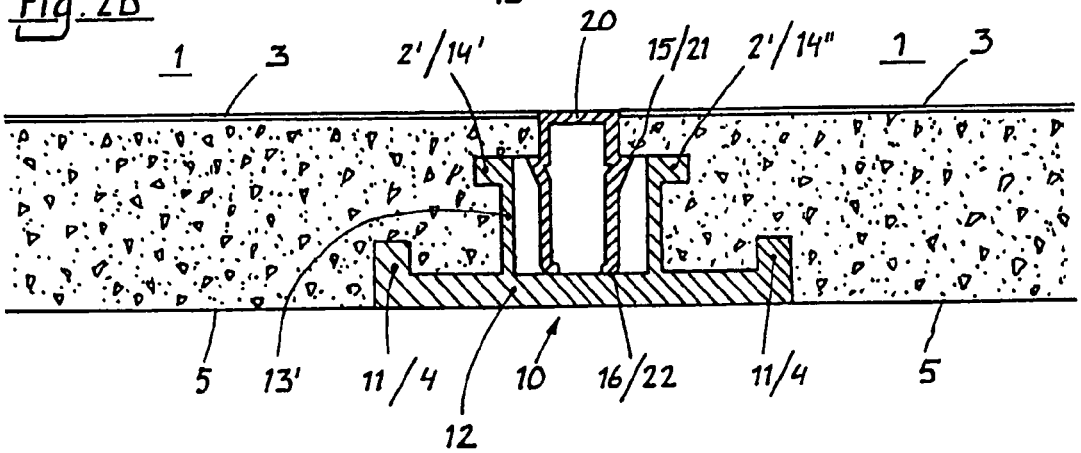
Figure 2C:
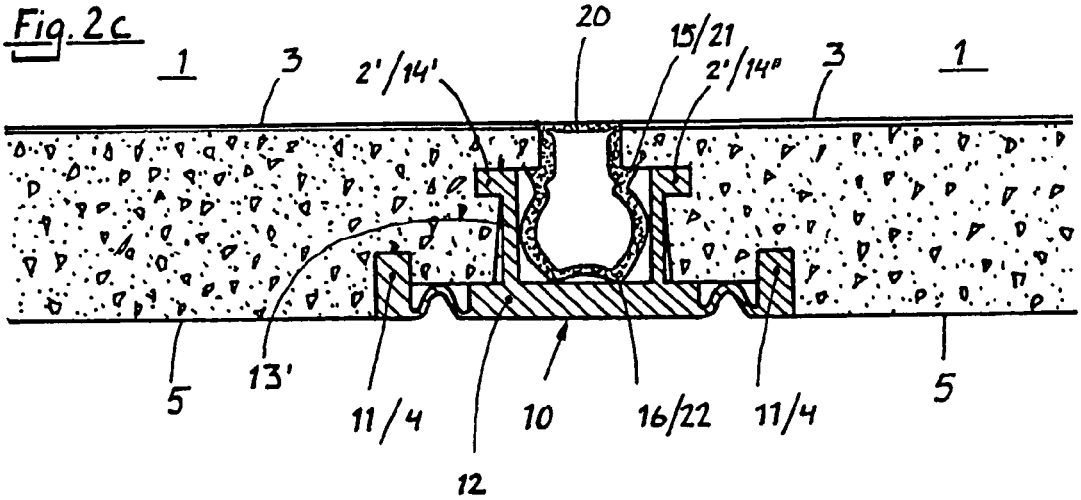

FIG. 2*a*-2*c* show different embodiments of a second alternative embodiment of a flooring material according to the invention.

FIG. 1*a*-1*c* show in exploded view, schematically and in cross-section the same embodiment of a vertically joined flooring material according to the invention. The flooring material is shown before (FIG. 1*a*), during (FIG. 1*b*) and after (FIG. 1*c*) the assembly. The floor boards 1 are provided with edges 2 which are provided with a notch 2' a lower side 5 and a top surface. The floor boards 1 are intended to be joined by means of separate joining profiles 10. All edges 2 are provided with one groove 4 each, which grooves 4 are arranged parallel to their respective edges 2. The grooves are placed on the lower side 5 at a distance of less than one fourth of the width of the floor board 1, from the closest edge 2. The section placed between the edges 2 and the grooves 4 has a thickness which is less than the maximum floor board thickness by a recess 6 on the lower side 5 of the floor board 1. The thickness of the floor board 1 is normally between 5 and 15 mm whereby a suitable depth of the recess is 1-5 mm. The joining profile 10 is provided with lips 11 arranged in pairs. The lips 11 are each intended to be received by one of the grooves 4 of a floor board 1 so that adjacent floor boards 1 with the grooves at the adjacent edges 2 are guided and fixed horizontally via the lips 11 of a joining profile 10. The lips 11 are connected to each other via a middle section 12 on the joining profile 10. The floor boards 1 will hereby be forced against each other whereby gaps can be avoided. The joining profiles 10 are provided with a central cheek section 13 which is constituted by a first and a second independently resilient cheek 13' and 13" respectively. The cheeks 13' and 13" respectively, are provided with each one tongue 14' and 14" respectively. The tongues 14' and 14" respectively are intended to be received by each one notch 2' whereby adjacent floor boards 1 are guided in the vertical direction. The joining profiles 10 are manufactured in lengths exceeding the length of a floor board 1 and are cut to the desired length at the assembly. It is possible to provide the joining profiles 10 in the from of rolls. The embodiment shown in the FIGS. 1*a*-*c* will give a minimum of machining and loss of the costly decorative upper surface 3 during manufacturing.

FIG. 1*a* shows a vertical plane P, which includes a distal end of the floor board 1. Additionally, the notch 2' is defined by a shoulder 30, which also terminates in a distal end 32. An indentation 34, between vertical plane P and the distal end of the shoulder 32, is shown as having a width greater than the width of cheek 13".

The floor boards 1 most often includes a core which is covered with an upper decorative surface layer 3. The core is most often constituted of saw dust, fibre or particles of wood which are bonded together with glue or resin. Since the cellulose based material in the core is sensitive to moisture, it is advantageous to coat the surface closest to the joint if the floor will be exposed to moisture. This surface treatment may include wax, resin or some kind of lacquer. It is not necessary to coat the joint when the floor boards are to be glued together since the glue itself will protect from penetration of moisture. The upper decorative surface 3 is constituted by a decorative paper impregnated with melamine-formaldehyde resin. One or more layers of so-called overlay paper made of α-cellulose which are impregnated with melamine-formaldehyde resin are advantageously placed on top of the decorative paper. One or more of the layers may be sprinkled with hard particles, of for example, α-aluminium oxide, silicon oxide or silicon carbide in connection to the impregnation in order to improve the abrasion resistance. The lower side 5 may be surface treated with lacquer or a surface layer of paper and resin.

FIG. 2*a*-2*c* shows schematically and in cross-section different embodiments of an alternative embodiment of a vertically joined flooring material according to the invention. The floor boards 1 are provided with edges 2 which are provided with a notch 2', a lower side 5 and an upper decorative surface 3. The floor boards 1 are intended to be joined by means of separate joining profiles 10. All edges 2 are provided with each one groove 4, which grooves 4 are arranged parallel to its respective edge 2. The grooves 4 on the lower side 5 are arranged on distance of less than one quarter, of the width of the floor board 1, from the closest edge 2. The section placed between the edges 2 and the grooves 4 has a thickness which is less than the maximum floor board thickness by a recess 6 on the lower side 5 of the floor board 1. The thickness of the floor board 1 is normally between 5 and 15 mm whereby a suitable depth of the recess is 1-5 mm. The joining profile 10 is provided with lips 11 arranged in pairs. The lips 11 are arranged on a greater distance from each other than as previously shown in FIG. 1. The lips 11 are each intended to be received by one of the grooves 4 of a floor board 1 so that adjacent floor boards 1 with the grooves 4 at the adjacent edges 2 are guided and fixed horizontally via the lips 11 of a joining profile 10. The lips 11 are connected to each other via a middle section 12 on the joining profile 10. The floor boards 1 will hereby be forced against each other whereby gaps can be avoided. The joining profiles 11 are provided with a central cheek section 13 which is constituted by a first and a second independently resilient cheek 13' and 13" respectively. The cheeks 13' and 13" respectively are placed at a greater distance from each other than as previously shown in FIG. 1. The cheeks 13' and 13" respectively are provided with each one tongue 14' and 14" respectively. The tongues 14' and 14" respectively are intended to be received by each one notch 2' whereby adjacent floor boards 1 are guided in the vertical direction. The joining profiles 10 are manufactured in lengths exceeding the length of a floor board 1 and are cut to the desired length during the installation. It is possible to provide the joining profiles 10 in the from of rolls. The embodiments shown in the FIGS. 2*a*-*c* will give a minimum of machining and loss of the costly decorative upper surface 3 during manufacturing. A decorative strip 20 is assembled from above, into the gap that is formed between two floor boards 1. The decorative strip 20 is provided with heels 21 at its lower part. The heels 21 are intended to interact with depressions 15 on the joining profile 10. The decorative strip 20 is furthermore provided with shoulders 22 which are intended to interact with edges 16 on the joining profile 10.

Such a decorative strip 20 may be used to increase the decorative effect in a floor and may be installed between every other or third floor board 1 as well as between each of the boards. The upper surface of the decorative strip 20 may, for example, be covered with a decorative thermosetting laminate with a pattern that matches the surface the rest of the floor is provide with. The decorative strip is then suitably manufactured of a thermosetting resin or a thermoplastic material with 15-60% filler for example in the form of saw dust.

It is also possible to use the decorative strip 20 as a dilatation device (FIG. 2*c*) in order to absorb movements in the floor caused thermal or moisture related expansion in the floor. The decorative strip is then suitably manufactured of a thermoplastic elastomer.

The invention is not limited to the embodiments shown since these can be varied in different ways within the scope of the invention.

The invention claimed is:

1. A floor comprising:

a plurality of floor boards, each of said floor boards comprising edges, at least one of said edges having a distal end lying in a vertical plane, a lower side, a decorative top surface, a notch formed in said edge below said decorative upper surface, wherein at least part of said notch is defined by a shoulder, said shoulder terminating in a distal end, whereby the floor boards are joinable by means of separate joining profiles, wherein at least one of said edges is provided with at least one groove, which groove is arranged parallel to its respective edge, and that the joining profiles comprise lips arranged in pairs, which lips are parallel and each extend in the same direction and said joining profile and lips, when inserted into said groove, do not extend beyond said lower side, and said lips are received by the at least one groove of a respective floor board so that adjacent floor boards with the grooves at the adjacent edges are guided and fixed horizontally by the lips of the joining profile, which lips are connected to each other by a middle section of the joining profile and that the joining profile is provided with a central cheek section which is comprised by a first resilient cheek and a second independently resilient cheek, each of said cheeks having a width and one tongue, and each tongue terminates at its respective resilient cheek, whereby each tongue is received by said notch so that adjacent floor boards are fixed in a vertical direction and wherein a distance between said plane including the distal end of the edge and said distal end of the shoulder is greater than the width of at least one of the first and second cheeks.

2. The floor according to claim 1, wherein the groove of the floor board is on the lower side and is arranged at a distance from the closest edge less than half of the width of a floor board.

3. The floor according to claim 2, wherein the floor boards are provided with a groove at the edges and that the distance between each groove and the closest edge is about the same.

4. The floor according to claim 2, wherein the part of the floor board located between each edge and its respective groove is thinner than the maximum thickness of the floor board by means of a recess located on the lower side.

5. The floor according to claim 1, wherein the distance between a center of one lip to a center of the second lip of the joining profile is less than the distance between a center of one groove on a first board to a center of a second groove on an adjacent board.

6. The floor according to claim 1, wherein the joining profiles are partially coated with glue or adhesive tape.

7. The floor according to claim 1, wherein the grooves on the lower side are arranged at a distance from the closest edge less than one quarter of the width of the floor board.

8. The floor according to claim 1, wherein the top surface of the floor board is flush with the top surface of an adjacent floor board, and the lower sides of the floor board are is flush with the joining profile.

9. The floor according to claim 1, wherein the upper surface of the floor boards have a shape selected from the group consisting of square, rhombus and rectangle.

10. The floor according to claim 1, wherein the floor boards are partially coated with glue.

11. Joining profile comprising:

two upstanding lips extending parallel to each other in the same direction, disposed at opposite ends of and perpendicular to a planar, longitudinally extending middle section having a midpoint, such that the middle section terminates with the upstanding lips;

a central cheek section located substantially at the midpoint of the middle section, said central cheek section comprising first and second independently resilient cheeks, wherein the cheeks extend in the same direction as the lips, and not below the middle section;

each of said first and second resilient cheeks comprising a tongue, extending perpendicular with respect to said respective cheek;

wherein the joining profile is formed from a material selected from the group consisting of a thermoplastic, polystyrene, polyvinyl chloride and acrylonitrile-butadiene-styrene copolymer.

12. Joining profile according to claim 11, wherein the joining profiles are manufactured in long sections exceeding the length of a floor board which may be cut into a desired length.

13. Joining profile according to claim 11, wherein said first and second resilient cheeks are separated by a space, said space being large enough to permit deflection of one of said first and second resilient cheeks without contacting the other of said first and second resilient cheeks.

14. Joining profile according to claim 11, wherein the material is an extruded thermoplastic material.

15. Joining profile according to claim 11, wherein the thermoplastic material is a polyolefin.

16. Joining profile according to claim 11, wherein the material is an injection molded material.

* * * * *